United States Patent [19]

Usami

[11] 4,089,529

[45] May 16, 1978

[54] BOARD GAME

[75] Inventor: Hikoo Usami, Tokyo, Japan

[73] Assignee: Tomy Kogyo Co., Inc., Tokyo, Japan

[21] Appl. No.: 772,136

[22] Filed: Feb. 25, 1977

[30] Foreign Application Priority Data

Jun. 10, 1976 Japan ..... 5168583

[51] Int. Cl.[2] ..... A63F 3/00

[52] U.S. Cl. ..... 273/282; 273/288; 273/236; 273/287

[58] Field of Search ..... 273/130 R, 136 E

[56] References Cited

U.S. PATENT DOCUMENTS

| | | | |
|---|---|---|---|
| 2,863,664 | 12/1958 | Jones | 273/130 R |
| 3,048,402 | 8/1962 | Schaper | 273/120 R |
| 3,126,205 | 3/1964 | Jordan | 273/130 R |
| 3,488,052 | 1/1970 | Weisbecker | 273/130 R |

*Primary Examiner*—Robert W. Michell

*Assistant Examiner*—Arthur S. Rose

*Attorney, Agent, or Firm*—Staas & Halsey

[57] ABSTRACT

A board game having a housing provided with a window and two openings on opposite sides thereof, a slide mechanism mounted for movement within the housing and provided on the top thereof with a predetermined color-coded pattern for viewing through the window, two bars operatively mounted to move with the slide mechanism and with respect to each other, two wheels mounted to rotate in response to movement of the bars and provided with upstanding posts offset from the centers of rotation of the wheels, an operating handle for moving the slide mechanism and the bars, a plurality of playing pieces for each player, each such playing piece being provided with a flange extending inwardly to prevent the post of the wheel from rotating and indicia, the positions of the flanges of the playing pieces corresponding to the indicia and the color-coded pattern on the slide mechanism in a predetermined manner.

9 Claims, 13 Drawing Figures

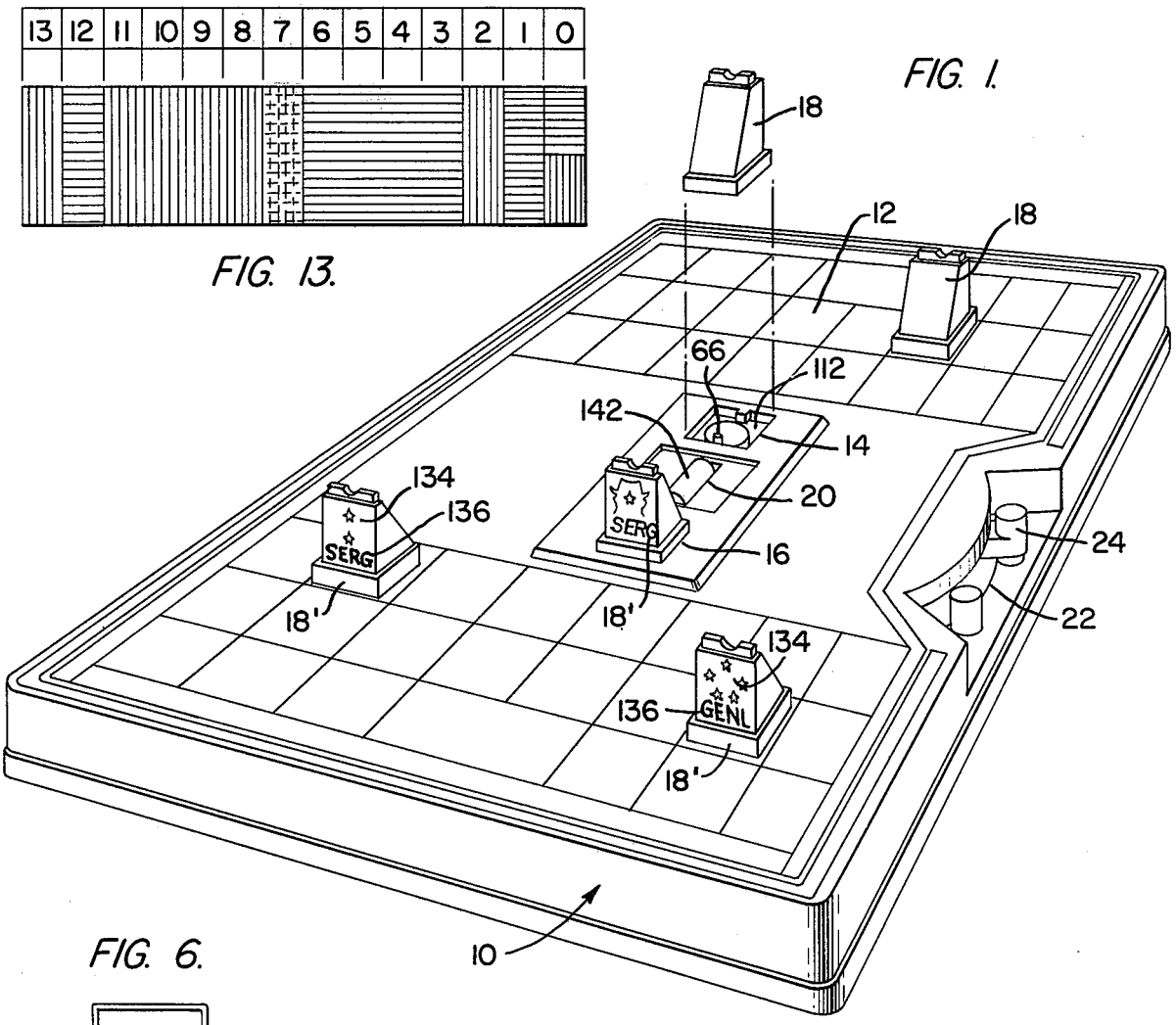
13 12 11 10 9 8 7 6 5 4 3 2 1 0
FIG. 13.
FIG. 1.
18
12
18
66
112
142
14
134
136
20
SERG
16
24
22
18'
18'
134
136
GENL
18'
10
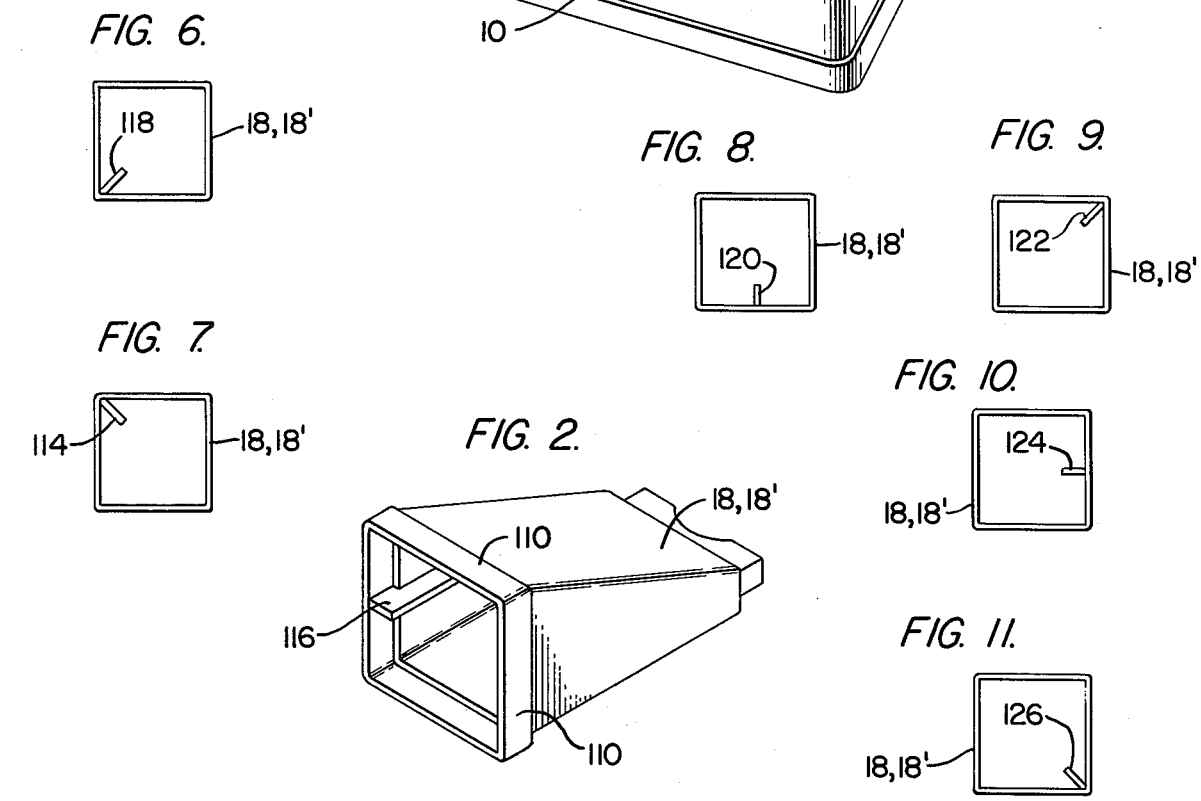
FIG. 6.
118
18,18'
FIG. 8.
120
18,18'
FIG. 9.
122
18,18'
FIG. 7.
114
18,18'
FIG. 2.
18,18'
110
116
110
FIG. 10.
124
18,18'
FIG. 11.
126
18,18'

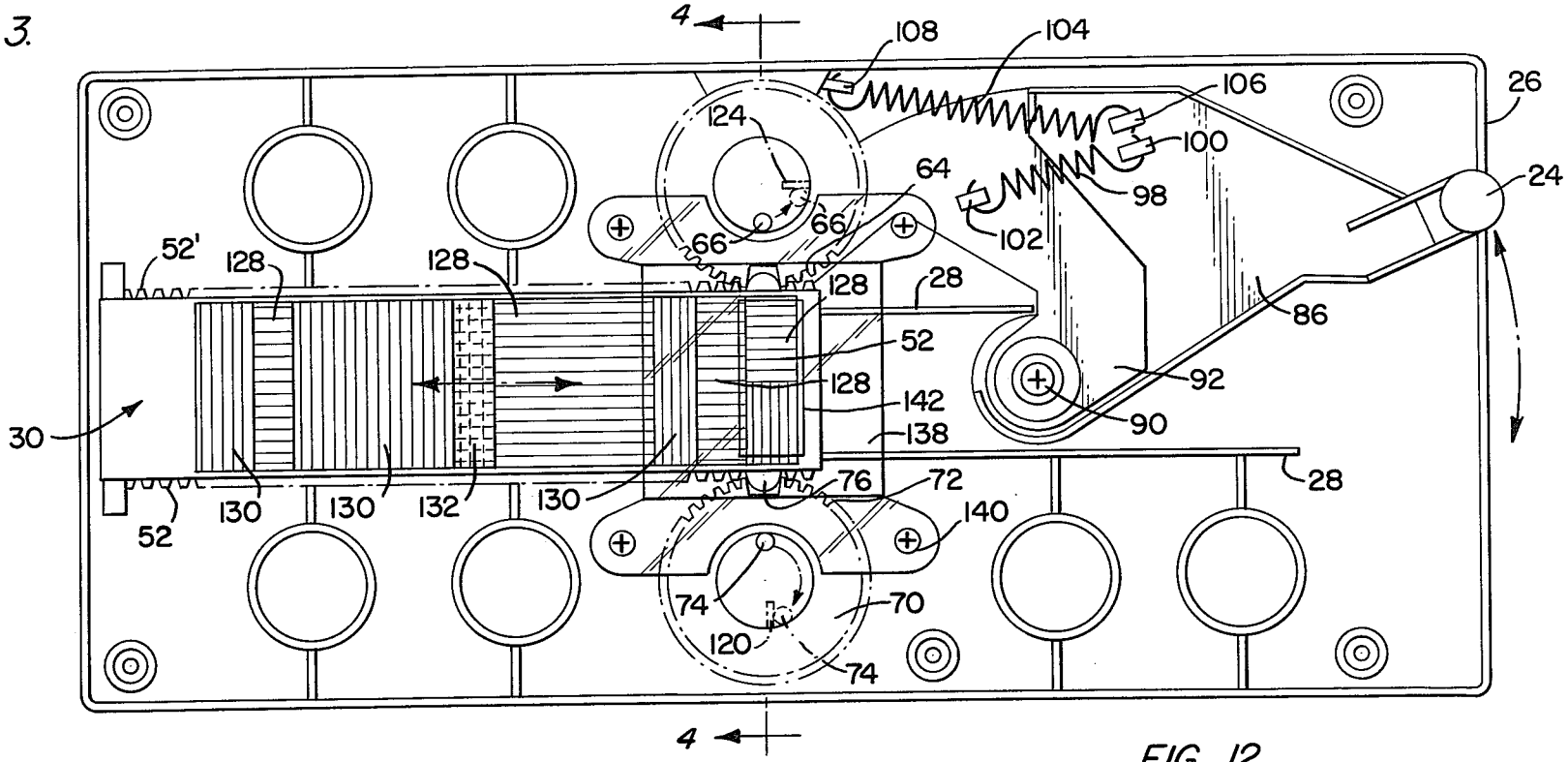
FIG. 3.
| | SPY | SAP | P2-C | SERG | OFF'R | GENL | TANK |
|---|---|---|---|---|---|---|---|
| RED | 7 | 6 | 5 | 4 | 3 | 2 | 1 |
| | 8 | 7 | 6 | 5 | 4 | 3 | 2 |
| | 9 | 8 | 7 | 6 | 5 | 4 | 3 |
| | 10 | 9 | 8 | 7 | 6 | 5 | 4 |
| | 11 | 10 | 9 | 8 | 7 | 6 | 5 |
| | 12 | 11 | 10 | 9 | 8 | 7 | 6 |
| | 13 | 12 | 11 | 10 | 9 | 8 | 7 |
| BLUE | SPY | SAP | P2-C | SERG | OFF'R | GENL | TANK |
FIG. 12.
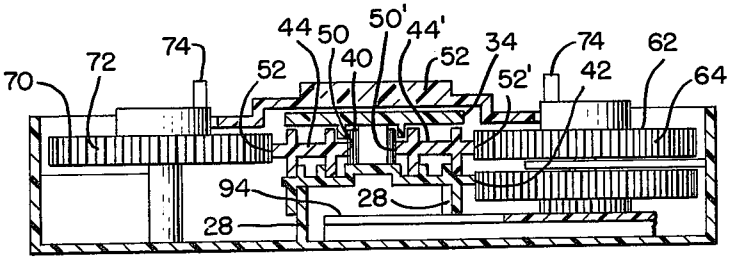
FIG. 4.

BOARD GAME

BACKGROUND AND SUMMARY OF INVENTION

The present invention relates to the general category of games wherein playing pieces of different rank or significance are selectively bidded by the players. More particularly, in the board game of the present invention each player is provided with a plurality of playing pieces having flanges arranged in different patterns and indicia of different rank corresponding to the positions of the flanges. A slide mechanism is mounted for movement below the playing surface and is provided on the top thereof with a predetermined color-coded pattern which relates to the positions of the flanges of the playing pieces and the indicia thereon. The slide mechanism is provided with two bars which are operatively mounted to move with the slide movement and in opposite directions with respect to each other. Two wheels, mounted to move in response to movement of the bars, are provided with upstanding posts which are offset from the centers of rotation. An operating handle is used to move the slide mechanism and the bars. Each player positions a playing piece of selected rank within an opening provided in the playing surface through which the posts of the wheels extend. Thereafter, the operating handle is actuated causing the slide mechanism and the bars to move in unison until the flange of one of the playing pieces engages the post of its corresponding wheel preventing the wheel from moving, afterwhich the slide mechanism and the other bar continue their movement until the flange of the other playing piece engages the post of the other wheel preventing the wheel from moving thus halting movement of the slide mechanism, at which time a portion of the color-coded pattern corresponding to the color of the winning playing piece is displayed through an opening provided in the playing surface.

BRIEF DESCRIPTION OF THE DRAWINGS

FIG. 1 is a perspective view of the board game of the present invention, illustrating the opening through which a part of the color-coded pattern of the slide mechanism is displayed, the two openings on opposite sides of the slide mechanism into which the players position their selected pieces, and the operating handle for causing the slide mechanism to move;

FIG. 2 is a perspective view of one of the playing pieces, illustrating the base thereof and one of the flange configurations;

FIG. 3 is a top plan view of the board game of the present invention with the cover thereof removed so as to expose the slide mechanism, the bars operatively mounted thereto, the rotatively mounted wheels associated with the bars which are provided with offset posts extending upwardly therefrom, and the operating handle;

FIG. 4 is a sectional view taken along line 4—4 of FIG. 3;

FIGS. 6–11 are schematic views illustrating the different positions of the flanges of the playing pieces corresponding to the different ranks associated with the playing pieces;

FIG. 12 is a chart illustrating the relationship between the ranks of the playing pieces of each player and the dimensional relationship of the widths of the color-coded stripes of the slide mechanism; and FIG. 13 is a chart illustrating the relative dimensional relationship of the widths of the color-coded stripes of the slide mechanism on a scale of 0–13.

DESCRIPTION OF THE PREFERRED EMBODIMENT

Figure 5:
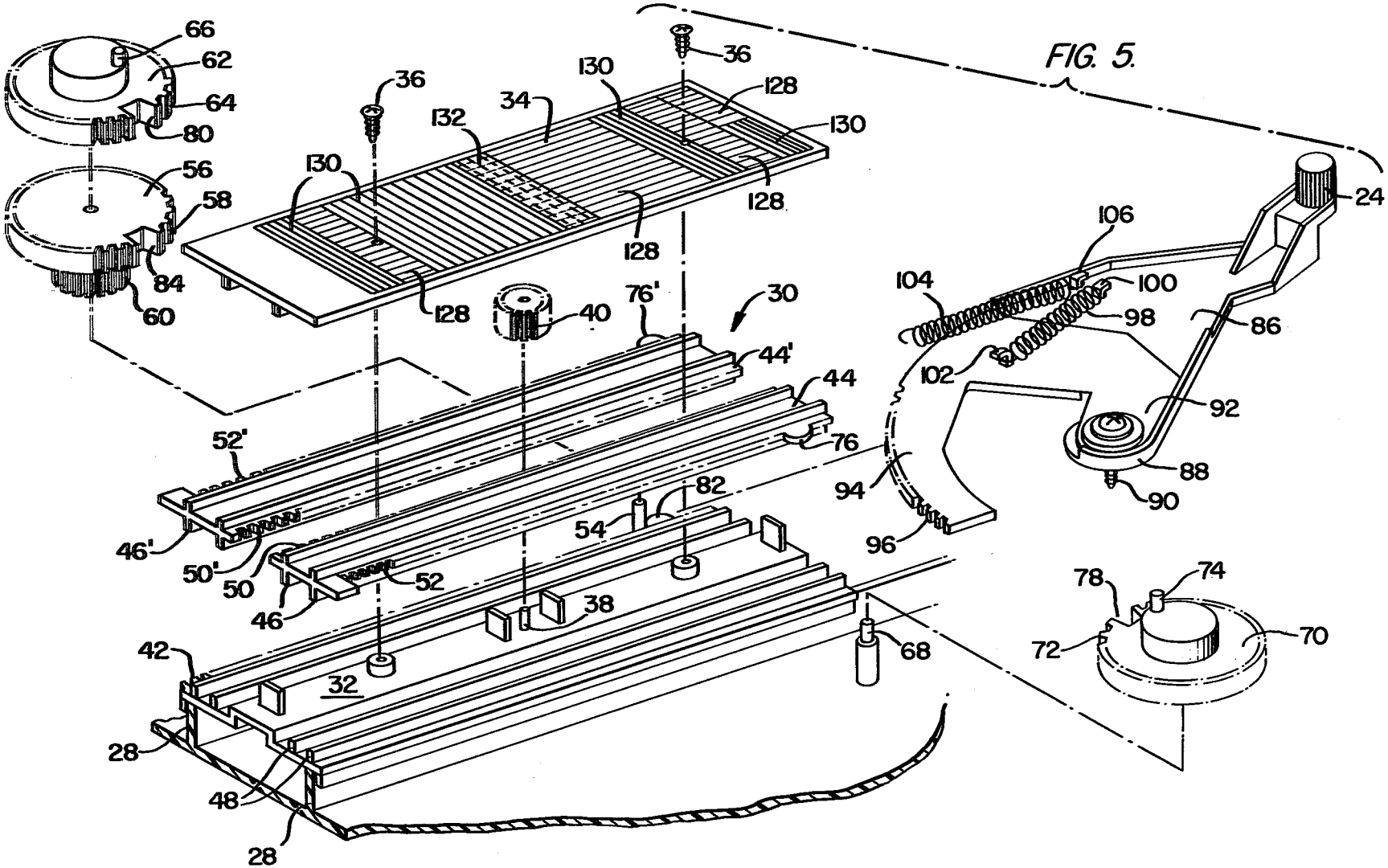
FIG. 5 is an exploded perspective view of the slide mechanism, bars, rotatively mounted wheels, and operating handle.

The amusement device of the present invention, as illustrated in FIG. 1, includes a housing 10 provided with a playing surface 12 having openings 14 and 16 therein into which a plurality of playing pieces 18 described hereinafter may be inserted, a window 20, and a slot 22 in the side thereof through which operating handle 24 protrudes.

Mounted below the playing surface 12 of the housing 10 is a chassis 26 which, as illustrated in FIG. 3, is provided with rails 28 along which a slide mechanism generally designated by the reference numeral 30 is mounted for movement. The slide mechanism 30, as illustrated in detail in FIG. 5, consists of a base 32 and a cover 34 fixedly secured thereto with fasteners 36. The base 32 is provided with a post 38 extending upwardly therefrom around which a gear wheel 40 is mounted for rotation. A rack of teeth 42 is provided along one side of the base 32.

Mounted for sliding movement within the cavity defined by the walls of the base 32 and the cover 34 are two bars generally designated by the reference numerals 44 and 44′. It will be apparent from FIGS. 4 and 5 that each of the bars 44 and 44′ is provided with legs 46 and 46′ extending downwardly therefrom which rest against corresponding legs 48 and 48′ extending upwardly from the base 32 thus permitting the bars 44 and 44′ to slide along axes parallel to the axis along which the slide mechanism 30 moves. The bars 44 and 44′ are provided with racks of teeth 50 and 50′ along the inside surfaces thereof which mesh with the teeth of the gear wheel 40, such that the bars 44 and 44′ move in unison and in opposite directions. The bars 44 and 44′ are also provided with racks of teeth 52 and 52′ on the opposite sides from the racks 50 and 50′.

The chassis 26 is provided with a shaft 54 extending upwardly therefrom which passes through an opening provided in a gear wheel 56 which is provided with two sets of teeth 58 and 60 along the periphery of the sections thereof. The teeth 58 of the wheel 56 mesh with the rack of teeth 42 of the slide mechanism 30. Also mounted for rotation about the shaft 54 is the gear wheel 62 which is provided with teeth 64 along the periphery thereof and an upstanding post 66. From FIG. 5, it will be apparent that the teeth 64 of the wheel 62 mesh with the teeth 52′ of the bar 44′. In similar manner, the chassis 26 is provided with a shaft 68 extending upwardly therefrom which fits within an opening provided in a gear wheel 70 which is provided with teeth 72 along the periphery thereof and an upstanding post 74 offset from the center of rotation of the gear 70. The teeth 72 of the wheel 70 mesh with the teeth 52 of the bar 44. It will also be apparent that bars 44 and 44′ are provided with outstanding tabs 76 and 76′ which fit within the slot 78 of the wheel 70 and the slot 80 of the wheel 62. In similar manner, the base 32 of the slide mechanism 30 is provided with a tab 82 extending outwardly therefrom which fits within a slot 84 provided in the wheel 56.

The operating handle 24 is formed as an integral part of a plate 86 which is provided with an arm 88 having an opening through which the fastener 90 passes into the chassis 26. In this manner, the plate 86 rotates about an axis corresponding to the fastener 90. The fastener 90 also passes through an opening in a second plate 92 which is provided with a curvalinear arm 94 having a continuous rack of teeth 96 along the surface thereof. The plates 86 and 92 are normally biased together with a spring 98 having one end thereof secured to an abutment 100 extending upwardly from the plate 86 and the other end thereof secured to an abutment 102 extending upwardly from the plate 92. A second spring 104 has one end attached to an abutment 106 extending upwardly from the plate 86 and the other end thereof secured to an abutment 108 extending upwardly from the chassis 26. The spring 104 serves to normally rotate both the plates 86 and 92 in a counterclockwise direction about the fastener 90, as illustrated in FIG. 3, the result of which is to move the operating handle 24 to one side of the slot 22.

Each of the players is provided with a plurality of playing pieces 18, 18′ which, as illustrated in FIG. 2, terminate downwardly in a base defined by the four walls 110. The bases of the playing pieces 18, 18′ are designed to be inserted within the openings 14 and 16 provided in the playing surfaces 12 of the housing 10, as illustrated in FIG. 1. Note that below the openings 14 and 16 there are provided walls 112 against which the edges of walls 110 of the bases of the playing pieces 18, 18′ rest.

As illustrated in FIGS. 2 and 6–11, the playing pieces 18, 18′ of each player include flanges 114, 116, 118, 120, 122, 124 and 126 which extend inwardly from the walls 110 at different positions. Since the flanges 114, 116, etc. extend into the openings between the walls 110 of the playing pieces 18, 18′ distances sufficient to engage the posts 66 and 74, it will be apparent that after a particular playing piece 18, 18′ is positioned within the openings 14 and 16, the position of the flange 114, 116, etc. determines how far the posts 66 and 74 will rotate after the handle 24 is rotated.

For purposes of describing the mode of play, the playing pieces of one of the players are designated by the reference numeral 18 whereas the playing pieces of the other player are designated by the reference numeral 18′. From the foregoing, it will be apparent that the playing pieces 18 are inserted within the opening 14 within the playing surface 12 for purposes of determining the degree of rotation of the post 66 of the wheel 62. In like manner, the playing pieces 18′ are inserted within the opening 16 for purposes of determining the degree of rotation of the post 74 of the wheel 70. The playing pieces 18, 18′ are color-coded, and for purposes of illustrating play the pieces 18 are red and the pieces 18′ are blue.

The cover 34 of the slide mechanism 30 is also color-coded, and as illustrated in FIGS. 3 and 5 the reference numeral 128 designates the color blue, the reference numeral 130 designates the color red, and the reference numeral 132 designates the color yellow. See also FIG. 13 wherein the relative dimensional relationship of the widths of the color-coded stripes is illustrated on a scale of 0–13.

As further illustrated in FIG. 1, the playing pieces are each provided with a rear wall 134 bearing indicia 136 corresponding to the position of the flanges 114, 116, etc. For purposes of illustrating one of an infinite number of relationships between the indicia 136 appearing on the rear walls 134 of the playing pieces 18, 18′ and the position of the flanges 114, 116, etc., reference is made on the following chart:

| Indicia on Playing Piece | Flange Number |
|---|---|
| "SPY" | 114 (FIG. 7) |
| "SAP" | 116 (FIG. 2) |
| "P.2-C" | 118 (FIG. 6) |
| "SERG" | 120 (FIG. 8) |
| "TANK" | 122 (FIG. 9) |
| "GEN'L" | 124 (FIG. 10) |
| "Off'R" | 126 (FIG. 11) |

The game is played by each of the players positioning a chosen one of his playing pieces 18, 18′ within his opening 14, 16. The indicia 136 being on the back wall 134 of the playing pieces 18, 18′, it will be apparent that the players cannot see the rank or quality of the playing piece chosen by his opponent. The operating handle 24 is then moved causing the plates 86 and 92 to rotate about the fastener 90 in turn propelling the slide mechanism 30 to the right, as illustrated in FIG. 3. The degree to which the slide mechanism 30 moves depends upon the degree to which the posts 66 and 74 are permitted to rotate. Eventually, the slide mechanism 30 stops, at which time the color of the indicia 128 (blue), 130 (red), and 132 (yellow) of the cover 34 is visible through the opening 20 provided in the playing surface 12. Note from FIG. 3 that the reference numeral 138 designates a plate which is appropriately mounted with fasteners 140 to the chassis 26 and which includes in the midportion thereof a transparent magnifying element 142 which protrudes upwardly through the opening 20 so as to magnify the color being displayed by the cover 34 of the slide mechanism 30.

In the starting position, the stripe having both blue 128 and red 130 colors is displayed through the magnifying element 20, as illustrated in FIG. 3. For purposes of illustration in FIG. 3 it is assumed that the red playing piece 18 that has been selected and positioned within the opening 14 includes the flange 124 corresponding to "GEN'L" and that the blue playing piece 18′ that has been selected and positioned within the opening 16 includes the flange 120 corresponding to "SERG". The flange 120 will permit the post 74 to rotate approximately 180°, whereas the flange 124 will permit the post 66 to rotate approximately 90°. This means that the slide mechanism 30 and the bars 44 and 44′ will move to the right uniformly until the post 66 strikes the flange 124, after which the post 66 and the wheel 62 are prevented from rotating. Thereafter, the slide mechanism 30 and the bar 44 will continue to move to the right while the post 74 continues to rotate until the post 74 strikes the flange 120, at which time the slide mechanism 30 abruptly halts its movement to the right. In this position, the blue color 128 is displayed through the opening 20 designating that the blue playing piece 18′ has won the bout. The relationship of the red playing pieces 18 and the blue playing pieces 18′ to the relative dimensional relationship of the widths of the color-coded stripes, as represented by the scale 0–13, is set forth in the chart of FIG. 12, wherein it will be apparent that with respect to the above example the segment number 5 of blue color will be displayed. The chart of FIG. 12 and the scale of FIG. 13 make it unnecessary to discuss in detail the various combinations that are possible. It will be apparent from FIGS. 12–13, however, that the yellow stripe 132, corresponding to position 7 on the scale, and designating a "tie" score, will be displayed each time opposing players of equal rank are selected. It should be understood that the foregoing examples of rank and relation are illustrative only as virtually an endless variety of indicia and ranking may be used with the present invention.

I claim:

1. An amusement device, comprising:

a housing provided with a window and two openings, a slide mechanism, coding means provided on said slide mechanism, and means mounting said slide mechanism to move with respect to said housing such that different portions of said coding means may be exposed through said window, bars, means mounting said bars to said slide mechanism, means connecting said bars such that movement of one of said bars in one direction causes the other of said bars to move in the opposite direction, wheels associated with said bars, means mounting said wheels to said housing for rotation, posts extending from said wheels through said openings, and means connecting said bars and said wheels such that movement of said bars causes said wheels to rotate, operating means for moving said slide mechanism, and a plurality of playing pieces associated with each of said wheels, said playing pieces being provided with indicia and flanges that block movement of said posts when said playing pieces are positioned within said openings of said housing, said flanges of different playing pieces being oriented differently to stop said posts at different positions and coordinated with said indicia and said coding means.

2. An amusement device as in claim 1, wherein said means connecting said bars comprises racks of teeth provided on said bars, and a gear wheel mounted to said slide mechanism for rotation and having teeth that engage said racks of teeth of said bars.

3. An amusement device as in claim 2, wherein said means connecting said bars and said wheels comprises racks of teeth provided on said bars and teeth provided on said wheels that engage the teeth of said racks of said bars.

4. An amusement device as in claim 3, wherein said operating means comprises a member, means mounting said member to said housing for movement, means normally urging said member to one position, a rack of teeth provided on said member, a wheel mounted to said housing for rotation and provided with teeth that engage the teeth of said rack of said member, and a rack provided on said slide mechanism having teeth that engage said teeth of said wheel.

5. An amusement device as in claim 4, wherein said member comprises two parts, said means mounting said member for movement comprising a post about which both of said parts are mounted for rotation, spring means connecting said parts normally urging same together, said rack being provided on one of said parts, said means urging said member comprising a spring attached to said one of said parts and said housing, and an operating handle provided on the other of said parts.

6. An amusement device as in claim 1, wherein said posts are offset from the centers of rotation of said wheels.

7. An amusement device as in claim 1, wherein said coding means comprises a plurality of areas, said areas including at least two colors in a predetermined pattern, and wherein said playing pieces associated with said wheels are provided with said two colors, only said playing pieces of one of said colors being used by one player.

8. An amusement device as in claim 7, wherein said indicia of said playing pieces of each of said colors comprises a plurality of different indicia, said different indicia corresponding to said playing pieces of different flange orientation.

9. An amusement device as in claim 8, wherein each of said playing pieces comprises a base having opposed walls and an upstanding portion, said indicia being located on said upstanding portion, and said flanges extending outwardly from different parts of said walls.

* * * * *